US009584235B2

(12) United States Patent
Ojala

(10) Patent No.: US 9,584,235 B2
(45) Date of Patent: Feb. 28, 2017

(54) MULTI-CHANNEL AUDIO PROCESSING

(75) Inventor: Pasi Ojala, Kirkkonummi (FI)

(73) Assignee: Nokia Technologies Oy, Espoo (FI)

( * ) Notice: Subject to any disclaimer, the term of this patent is extended or adjusted under 35 U.S.C. 154(b) by 840 days.

(21) Appl. No.: 13/516,362

(22) PCT Filed: Dec. 16, 2009

(86) PCT No.: PCT/EP2009/067243
§ 371 (c)(1),
(2), (4) Date: Jul. 25, 2012

(87) PCT Pub. No.: WO2011/072729
PCT Pub. Date: Jun. 23, 2011

(65) Prior Publication Data

US 2013/0195276 A1 Aug. 1, 2013

(51) Int. Cl.

| | |
|---|---|
| ***H04H 20/47*** | (2008.01) |
| ***H04H 40/36*** | (2008.01) |
| ***G10L 19/008*** | (2013.01) |
| ***H04S 3/00*** | (2006.01) |
| *G10L 21/0216* | (2013.01) |

(52) U.S. Cl.
CPC ..... *H04H 40/36* (2013.01); *G10L 19/008* (2013.01); *H04S 3/008* (2013.01); *G10L 2021/02166* (2013.01); *H04S 2420/03* (2013.01)

(58) Field of Classification Search
CPC combination set(s) only.
See application file for complete search history.

(56) References Cited

U.S. PATENT DOCUMENTS

| | | | | |
|---|---|---|---|---|
| 6,163,608 | A * | 12/2000 | Romesburg | H04M 9/082 379/406.01 |
| 6,393,392 | B1 * | 5/2002 | Minde | G10L 19/16 704/219 |
| 2002/0173864 | A1 * | 11/2002 | Smith | H04M 3/40 700/94 |
| 2003/0169809 | A1 * | 9/2003 | Kim | H04L 25/03012 375/230 |
| 2005/0195981 | A1 * | 9/2005 | Faller et al. | 381/23 |
| 2007/0137466 | A1 * | 6/2007 | Lindemann | G10H 1/0066 84/626 |

(Continued)

FOREIGN PATENT DOCUMENTS

| | | |
|---|---|---|
| CN | 1973319 A | 5/2007 |
| CN | 101350197 A | 1/2009 |

(Continued)

OTHER PUBLICATIONS

Beack, S., et al., "Angle-Based Virtual Source Location Representation for Spatial Audio Coding", Apr. 2006, ETRI Journal, vol. 28, No. 2, 4 pgs.
Baumgarte, F., et al., "Binaural cue coding—Part II: Schemes and Applications (2003)", Abstract, IEEE Trans. Speech Audio Process, 1 pg.
Briand, M., et al., "Parametric Coding of Stereo Audio Based on Principal Component Analysis", Sep. 18-20, 2006, Proc. of 9th Intl. Conference on Digital Audio Effects (DAFX'06), Montreal, Canada, 7 pgs.
Fuchs, H., "Improving joint stereo audio coding by adaptive inter-channel prediction", Abstract, Oct. 17-20, 1993, Apps. of Signal Processing to Audio and Acoustics, 1 pg.

*Primary Examiner* — Duc Nguyen
*Assistant Examiner* — Assad Mohammed
(74) *Attorney, Agent, or Firm* — Harrington & Smith

(57) ABSTRACT

A method including: receiving at least a first input audio channel and a second input audio channel; and using an inter-channel prediction model to form at least an inter-channel direction of reception parameter.

23 Claims, 5 Drawing Sheets

(56) References Cited

U.S. PATENT DOCUMENTS

| | | | | |
|---|---|---|---|---|
| 2007/0174052 | A1* | 7/2007 | Manjunath | G10L 19/18 704/219 |
| 2007/0248157 | A1* | 10/2007 | Den Brinker | G10L 19/008 375/240 |
| 2007/0297519 | A1* | 12/2007 | Thompson | G10L 19/008 375/241 |
| 2008/0298597 | A1* | 12/2008 | Turku | H04S 5/00 381/27 |
| 2009/0067634 | A1* | 3/2009 | Oh | H04S 3/008 381/17 |
| 2009/0144063 | A1* | 6/2009 | Beack | G10L 19/008 704/500 |
| 2011/0060595 | A1* | 3/2011 | Trainor | G10L 19/22 704/500 |
| 2011/0081024 | A1* | 4/2011 | Soulodre | G01S 3/8006 381/17 |

FOREIGN PATENT DOCUMENTS

| | | | |
|---|---|---|---|
| TW | 200729708 | A | 8/2007 |
| TW | 200910328 | A | 3/2009 |
| WO | WO 2006/000952 | A1 | 1/2006 |
| WO | WO-2009/046223 | A2 | 4/2009 |

* cited by examiner

MULTI-CHANNEL AUDIO PROCESSING

FIELD OF THE INVENTION

Embodiments of the present invention relate to multi-channel audio processing. In particular, they relate to audio signal analysis, encoding and/or decoding multi-channel audio.

BACKGROUND TO THE INVENTION

Multi-channel audio signal analysis is used for example in multi-channel, audio context analysis regarding the direction and motion as well as number of sound sources in the 3D image, audio coding, which in turn may be used for coding, for example, speech, music etc.

Multi-channel audio coding may be used, for example, for Digital Audio Broadcasting, Digital TV Broadcasting, Music download service, Streaming music service, Internet radio, teleconferencing, transmission of real time multimedia over packet switched network (such as Voice over IP, Multimedia Broadcast Multicast Service (MBMS) and Packet-switched streaming (PSS))

BRIEF DESCRIPTION OF VARIOUS EMBODIMENTS OF THE INVENTION

According to various, but not necessarily all, embodiments of the invention there is provided a method comprising: receiving at least a first input audio channel and a second input audio channel; and using an inter-channel prediction model to form at least an inter-channel direction of reception parameter.

According to various, but not necessarily all, embodiments of the invention there is provided a computer program product comprising machine readable instructions which when loaded into a processor control the processor to:

receive at least a first input audio channel and a second input audio channel; and use an inter-channel prediction model to form at least an inter-channel direction of reception parameter.

According to various, but not necessarily all, embodiments of the invention there is provided an apparatus comprising a processor and a memory recording machine readable instructions which when loaded into a processor enable the apparatus to: receive at least a first input audio channel and a second input audio channel; and use an inter-channel prediction model to form at least an inter-channel direction of reception parameter.

According to various, but not necessarily all, embodiments of the invention there is provided an apparatus comprising: means for receiving at least a first input audio channel and a second input audio channel; and means for using an inter-channel prediction model to form at least an inter-channel direction of reception parameter.

According to various, but not necessarily all, embodiments of the invention there is provided a method comprising: receiving a downmixed signal and the at least one inter-channel direction of reception parameter; and using the downmixed signal and the at least one inter-channel direction of reception parameter to render multi-channel audio output.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

The illustrated multichannel audio encoder apparatus 4 is, in this example, a parametric encoder that encodes according to a defined parametric model making use of multi-channel audio signal analysis.

The parametric model is, in this example, a perceptual model that enables lossy compression and reduction of data rate in order to reduce transmission bandwidth or storage space required to accommodate the multi-channel audio signal.

The encoder apparatus 4, in this example, performs multi-channel audio coding using a parametric coding technique, such as for example binaural cue coding (BCC) parameterisation. Parametric audio coding models in general represent the original audio as a downmix signal comprising a reduced number of audio channels formed from the channels of the original signal, for example as a monophonic or as two channel (stereo) sum signal, along with a bit stream of parameters describing the differences between channels of the original signal in order to enable reconstruction of the original signal, i.e. describing the spatial image represented by the original signal. A downmix signal comprising more than one channel can be considered as several separate downmix signals.

The parameters may comprise at least one inter-channel parameter estimated within each of a plurality of transform domain time-frequency slots, i.e. in the frequency sub bands for an input frame. Traditionally the inter-channel parameters have been an inter-channel level difference (ILD) parameter and an inter-channel time difference (ITD) parameter. However, in the following the inter-channel parameters comprise inter-channel direction of reception (IDR) parameters. The inter-channel level difference (ILD) parameter and/or the inter-channel time difference (ITD) parameter may still be determined as interim parameters during the process of determining the inter-channel direction of reception (IDR) parameters.

In order to preserve the spatial audio image of the input signal, it is important that the parameters are accurately determined.

Figure 1:
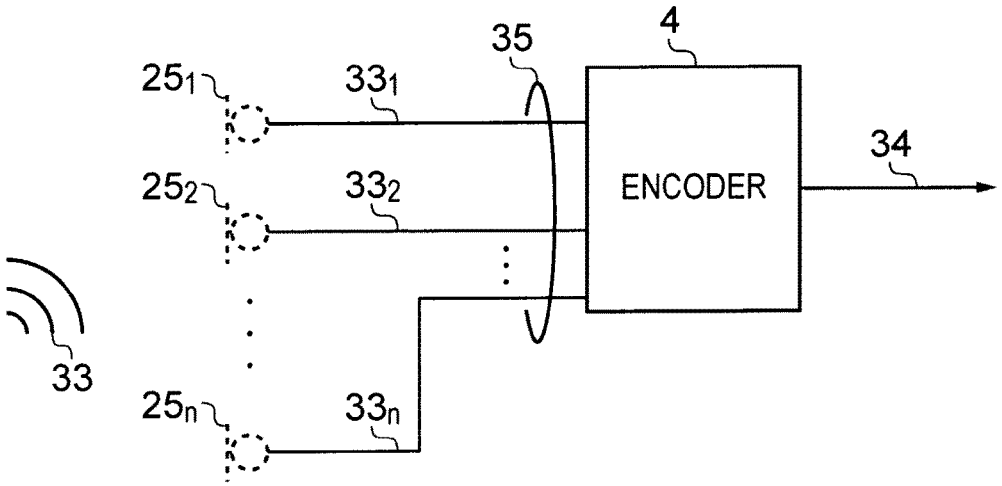
FIG. 1 schematically illustrates a system for multi-channel audio coding.

FIG. 1 schematically illustrates a system 2 for multi-channel audio coding. Multi-channel audio coding may be used, for example, for Digital Audio Broadcasting, Digital TV Broadcasting, Music download service, Streaming music service, Internet radio, conversational applications, teleconferencing etc.

A multi-channel audio signal 35 may represent an audio image captured from a real-life environment using a number of microphones $\mathbf{25}_n$ that capture the sound 33 originating from one or multiple sound sources within an acoustic space. The signals provided by the separate microphones represent separate channels $\mathbf{33}_n$ in the multi-channel audio signal 35. The signals are processed by the encoder 4 to provide a condensed representation of the spatial audio image of the acoustic space. Examples of commonly used microphone set-ups include multi-channel configurations for stereo (i.e. two channels), 5.1 and 7.2 channel configurations. A special case is a binaural audio capture, which aims to model the human hearing by capturing signals using two channels $\mathbf{33}_1$, $\mathbf{33}_2$ corresponding to those arriving at the eardrums of a (real or virtual) listener. However, basically any kind of multi-microphone set-up may be used to capture a multi-channel audio signal. Typically, a multi-channel audio signal 35 captured using a number of microphones within an acoustic space results in multi-channel audio with correlated channels.

A multi-channel audio signal 35 input to the encoder 4 may also represent a virtual audio image, which may be created by combining channels $\mathbf{33}_n$ originating from different, typically uncorrelated, sources. The original channels $\mathbf{33}_n$ may be single channel or multi-channel. The channels of such multi-channel audio signal 35 may be processed by the encoder 4 to exhibit a desired spatial audio image, for example by setting original signals in desired "location(s)" in the audio image in such a way that they perceptually appear to arrive from desired directions, possibly also at desired level.

Figure 2:
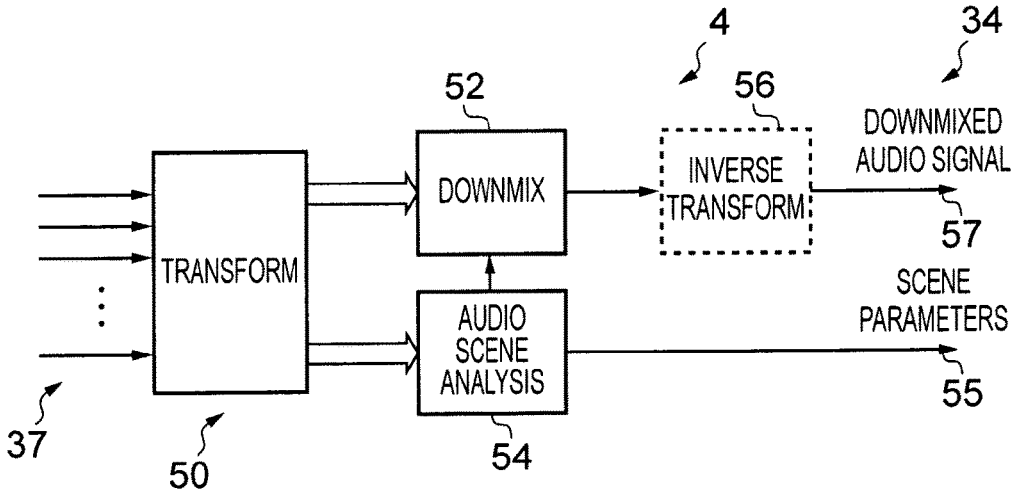
FIG. 2 schematically illustrates a encoder apparatus.

FIG. 2 schematically illustrates an encoder apparatus 4

The illustrated multichannel audio encoder apparatus 4 is, in this example, a parametric encoder that encodes according to a defined parametric model making use of multi-channel audio signal analysis.

The parametric model is, in this example, a perceptual model that enables lossy compression and reduction of bandwidth.

The encoder apparatus 4, in this example, performs spatial audio coding using a parametric coding technique, such as binaural cue coding (BCC) parameterisation. Generally parametric audio coding models such as BCC represent the original audio as a downmix signal comprising a reduced number of audio channels formed from the channels of the original signal, for example as a monophonic or as two channel (stereo) sum signal, along with a bit stream of parameters describing the differences between channels of the original signal in order to enable reconstruction of the original signal, i.e. describing the spatial image represented by the original signal. A downmix signal comprising more than one channel can be considered as several separate downmix signals.

A transformer 50 transforms the input audio signals (two or more input audio channels) from time domain into frequency domain using for example filterbank decomposition over discrete time frames. The filterbank may be critically sampled. Critical sampling implies that the amount of data (samples per second) remains the same in the transformed domain.

The filterbank could be implemented for example as a lapped transform enabling smooth transients from one frame to another when the windowing of the blocks, i.e. frames, is conducted as part of the sub band decomposition. Alternatively, the decomposition could be implemented as a continuous filtering operation using e.g. FIR filters in polyphase format to enable computationally efficient operation.

Channels of the input audio signal are transformed separately into frequency domain, i.e. into a number a frequency sub bands for an input frame time slot. Thus, the input audio channels are segmented into time slots in the time domain and sub bands in the frequency domain.

The segmenting may be uniform in the time domain to form uniform time slots e.g. time slots of equal duration. The segmenting may be uniform in the frequency domain to form uniform sub bands e.g. sub bands of equal frequency range or the segmenting may be non-uniform in the frequency domain to form a non-uniform sub band structure e.g. sub bands of different frequency range. In some implementations the sub bands at low frequencies are narrower than the sub bands at higher frequencies.

From perceptual and psychoacoustical point of view a sub band structure close to ERB (equivalent rectangular bandwidth) scale is preferred. However, any kind of sub band division can be applied.

An output from the transformer 50 is provided to audio scene analyser 54 which produces scene parameters 55. The audio scene is analysed in the transform domain and the corresponding parameterisation 55 is extracted and processed for transmission or storage for later consumption.

The audio scene analyser 54 uses an inter-channel prediction model to form inter-channel scene parameters 55.

The inter-channel parameters may, for example, comprise an inter-channel direction of reception (IDR) parameter estimated within each transform domain time-frequency slot, i.e. in a frequency sub band for an input frame.

In addition, the inter-channel coherence (ICC) for a frequency sub band for an input frame between selected channel pairs may be determined. Typically, IDR and ICC parameters are determined for each time-frequency slot of the input signal, or a subset of time-frequency slots. A subset of time-frequency slots may represent for example perceptually most important frequency components, (a subset of) frequency slots of a subset of input frames, or any subset of time-frequency slots of special interest. The perceptual importance of inter-channel parameters may be different from one time-frequency slot to another. Furthermore, the perceptual importance of inter-channel parameters may be different for input signals with different characteristics.

The IDR parameter may be determined between any two channels. As an example, the IDR parameter may be determined between an input audio channel and a reference channel, typically between each input audio channel and a reference input audio channel. As another example, the input channels may be grouped into channel pairs for example in such a way that adjacent microphones of a microphone array form a pair, and the IDR parameters are determined for each channel pair. The ICC is typically determined individually for each channel compared to a reference channel.

In the following, some details of the BCC approach are illustrated using an example with two input channels L, R and a single-channel downmix signal. However, the representation can be generalized to cover more than two input audio channels and/or a configuration using more than one downmix signal (or a downmix signal having more than one channel).

A downmixer 52 creates downmix signal(s) as a combination of channels of the input signals. The parameters describing the audio scene could also be used for additional processing of multi-channel input signal prior to or after the downmixing process, for example to eliminate the time difference between the channels in order to provide time-aligned audio across input channels.

The downmix signal is typically created as a linear combination of channels of the input signal in transform domain. For example in a two-channel case the downmix may be created simply by averaging the signals in left and right channels:

$$S_n = \frac{1}{2}(S_n^L + S_n^R) \quad \text{–Equation 1}$$

There are also other means to create the downmix signal. In one example the left and right input channels could be weighted prior to combination in such a manner that the energy of the signal is preserved. This may be useful e.g. when the signal energy on one of the channels is significantly lower than on the other channel or the energy on one of the channels is close to zero.

An optional inverse transformer 56 may be used to produce downmixed audio signal 57 in the time domain.

Alternatively the inverse transformer 56 may be absent. The output downmixed audio signal 57 is consequently encoded in the frequency domain.

The output of a multi-channel or binaural encoder typically comprises the encoded downmix audio signal or signals 57 and the scene parameters 55. This encoding may be provided by separate encoding blocks (not illustrated) for signal 57 and 55. Any mono (or stereo) audio encoder is suitable for the downmixed audio signal 57, while a specific BCC parameter encoder is needed for the inter-channel parameters 55. The inter-channel parameters may, for example include the inter-channel direction of reception (IDR) parameters.

Figure 3:
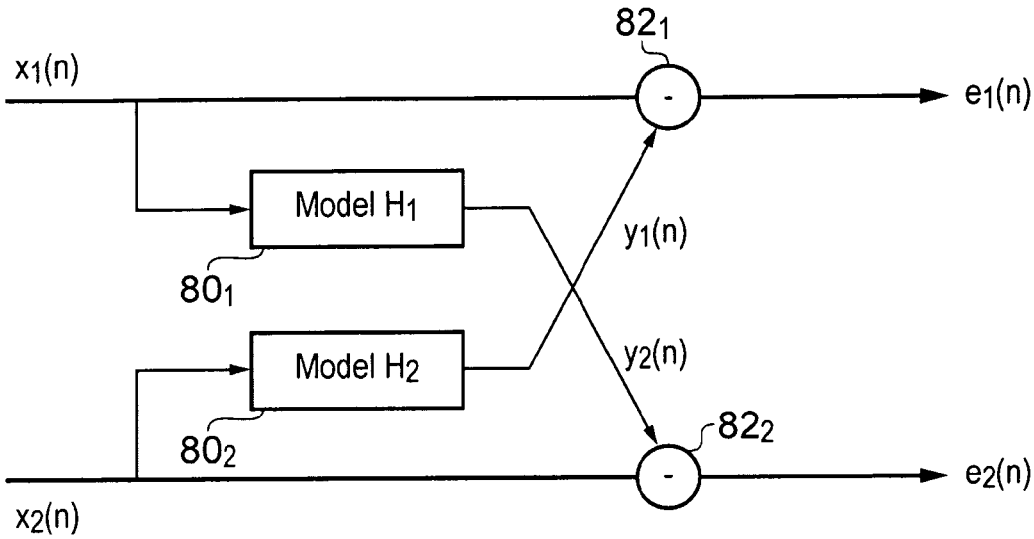
FIG. 3 schematically illustrates how cost functions for different putative inter-channel prediction models $H_1$ and $H_2$ may be determined in some implementations.

FIG. 3 schematically illustrates how cost functions for different putative inter-channel prediction models $H_1$ and $H_2$ may be determined in some implementations.

A sample for audio channel j at time n in a subject sub band may be represented as $x_j(n)$.

Historic past samples for audio channel j at time n in a subject sub band may be represented as $x_j(n-k)$, where $k>0$.

A predicted sample for audio channel j at time n in a subject sub band may be represented as $y_j(n)$.

The inter-channel prediction model represents a predicted sample $y_j(n)$ of an audio channel j in terms of a history of another audio channel. The inter-channel prediction model may be an autoregressive (AR) model, a moving average (MA) model or an autoregressive moving average (ARMA) model etc.

As an example based on AR models, a first inter-channel prediction model $H_1$ of order L may represent a predicted sample $y_2$ as a weighted linear combination of samples of the input signal $x_1$.

The input signal $x_1$ comprises samples from a first input audio channel and the predicted sample $y_2$ represents a predicted sample for the second input audio channel.

$$y_2(n) = \sum_{k=0}^{L} H_1(k)x_1(n-k) \quad \text{–Equation 2}$$

The model order (L), i.e. the number(s) of predictor coefficients, is greater than or equal to the expected inter channel delay. That is, the model should have at least as many predictor coefficients as the expected inter channel delay is in samples. It may be advantageous, especially when the expected delay is in sub sample domain, to have slightly higher model order than the delay.

A second inter-channel prediction model $H_2$ may represent a predicted sample $y_1$ as a weighted linear combination of samples of the input signal $x_2$.

The input signal $x_2$ contains samples from the second input audio channel and the predicted sample $y_1$ represents a predicted sample for the first input audio channel.

$$y_1(n) = \sum_{k=0}^{L} H_2(k)x_2(n-k) \quad \text{–Equation 3}$$

Although the inter-channel model order L is common to both the predicted sample $y_1$ and the predicted sample $y_2$ in this example, this is not necessarily the case. The inter-channel model order L for the predicted sample $y_1$ could be different to that for the predicted sample $y_2$. The model order L could also be varied from input frame to input frame, for example based on the input signal characteristics. Furthermore, in as alternative or additionally, the model order L may be different across frequency sub bands of an input frame.

The cost function, determined at block 82, may be defined as a difference between the predicted sample y and an actual sample x.

The cost function for the inter-channel prediction model $H_1$ is, in this example:

$$e_2(n) = x_2(n) - y_2(n) = x_2(n) - \sum_{k=0}^{L} H_1(k)x_1(n-k) \quad \text{–Equation 4}$$

The cost function for the inter-channel prediction model $H_2$ is, in this example:

$$e_1(n) = x_1(n) - y_1(n) = x_1(n) - \sum_{k=0}^{L} H_2(k)x_2(n-k) \quad \text{–Equation 5}$$

The cost function for a putative inter-channel prediction model is minimized to determine the putative inter-channel prediction model. This may, for example, be achieved using least squares linear regression analysis.

Prediction models making use of future samples may be employed. As an example, in real-time analysis (and/or encoding) this may be enabled by buffering a number of input frames enabling prediction based on future samples at desired prediction order. Furthermore, when analysing/encoding pre-stored audio signal, desired amount of future signal is readily available for the prediction process.

A recursive inter channel prediction model may also be used. In this approach, the prediction error is available on sample-by-sample basis. This method makes it possible to select the prediction model at any instant and update the prediction gain several times even within a frame. For example, the prediction model $f_1$ used to predict channel 2 using the data from channel 1 could be determined recursively as follows:

$$x_1(n)=[x_{1,n}x_{1,n-1}\ldots x_{1,n-p}]^T$$

$$e_2(n)=x_2(n)-f_1(n-1)^T x_1(n)$$

$$g(n)=P(n-1)x_1(n)(\lambda+x_1(n)^T P(n-1)x_1(n))^-$$

$$P(n)=\lambda^{-1}P(n-1)-g(n)x_1(n)^T\lambda^{-1}P(n-1)$$

$$f_1(n)=f_1(n-1)+e_2(n)g(n) \qquad \text{Equation 6}$$

where the initial values are $f_1(0)=[0\ 0\ \ldots\ 0]^T$, $P(0)=\delta^{-1}I$ is the initial state of matrix P(n), and p is the AR model order, i.e. the length of the vector f, and $\lambda$ is a forgetting factor having a value of e.g. 0.5.

In general, irrespective of the prediction model, the prediction gain $g_i$ for the subject sub band may be defined as:

$$g_1=\frac{x_2(n)^T x_2(n)}{e_1(n)^T e_1(n)} \qquad \text{–Equation 7}$$

$$g_2=\frac{x_1(n)^T x_1(n)}{e_2(n)^T e_2(n)}.$$

with respect to FIG. 3.

A high prediction gain indicates strong correlation between channels in the subject sub band.

The quality of the putative inter-channel prediction model may be assessed using the prediction gain. A first selection criterion may require that the prediction gain $g_i$ for the putative inter-channel prediction model $H_i$ is greater than an absolute threshold value $T_1$.

A low prediction gain implies that inter channel correlation is low. Prediction gain values below or close to unity indicate that the predictor does not provide meaningful parameterisation. For example, the absolute threshold may be set at $10\log_{10}(g_i)=10$ dB.

If prediction gain $g_i$ for the putative inter-channel prediction model $H_i$ does not exceed the threshold, the test is unsuccessful. It is therefore determined that the putative inter-channel prediction model $H_i$ is not suitable for determining the inter-channel parameter.

If prediction gain $g_i$ for the putative inter-channel prediction model $H_i$ does exceed the threshold, the test is successful. It is therefore determined that the putative inter-channel prediction model $H_i$ may be suitable for determining at least one inter-channel parameter.

A second selection criterion may require that the prediction gain $g_i$ for the putative inter-channel prediction model $H_i$ is greater than a relative threshold value $T_2$.

The relative threshold value $T_2$ may be the current best prediction gain plus an offset. The offset value may be any value greater than or equal to zero. In one implementation, the offset is set between 20 dB and 40 dB such as at 30 dB.

The selected inter-channel prediction models are used to form the IDR parameter

Initially an interim inter-channel parameter for a subject audio channel at a subject domain time-frequency slot is determined by comparing a characteristic of the subject domain time-frequency slot for the subject audio channel with a characteristic of the same time-frequency slot for a reference audio channel. The characteristic may, for example, be phase/delay and/or it may be magnitude.

Figure 4:
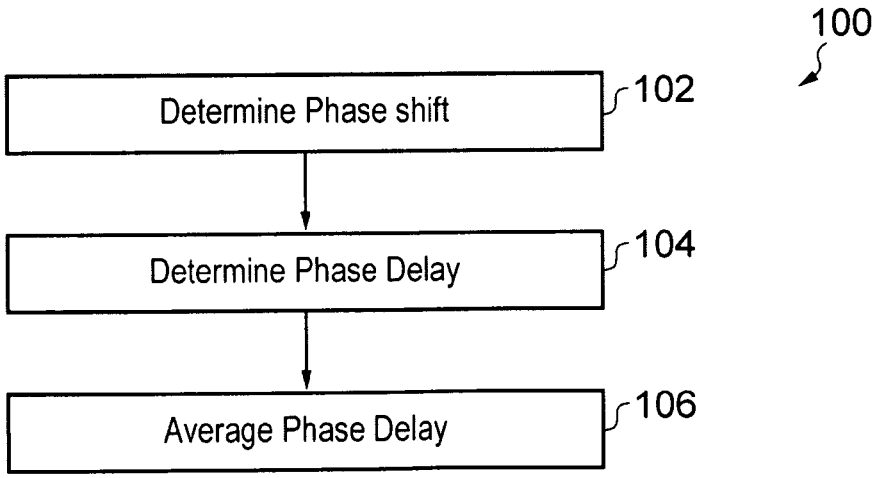
FIG. 4 schematically illustrates a method for determining an inter-channel parameter from the selected inter-channel prediction model H.

FIG. 4 schematically illustrates a method 100 for determining a first interim inter-channel parameter from the selected inter-channel prediction model $H_i$ in a subject sub band.

At block 102, a phase shift/response of the inter-channel prediction model is determined.

The inter channel time difference is determined from the phase response of the model. When $$H(z)=\sum_{k=0}^{L} b_k z^{-k},$$

the frequency response is determined as $$H(e^{j\omega})=e^{-j\omega L}\sum_{k=0}^{L} b_k e^{j\omega k}.$$

The phase shift of the model is determined as $$\phi(\omega)=\angle(H(e^{j\omega})) \qquad \text{Equation 9}$$

At block 104, the corresponding phase delay of the model for the subject sub band is determined:

$$\tau_\phi(\omega)=-\frac{\phi(\omega)}{\omega}. \qquad \text{–Equation 10}$$

At block 106, an average of $\tau_\phi(\omega)$ over a number of sub bands may be determined.

The number of sub bands may comprise sub bands covering the whole or a subset of the frequency range.

Since the phase delay analysis is done in sub band domain, a reasonable estimate for the inter channel time difference (delay) within a frame is an average of $\tau_\phi(\omega)$ over a number of sub bands covering the whole or a subset of the frequency range.

Figure 5:
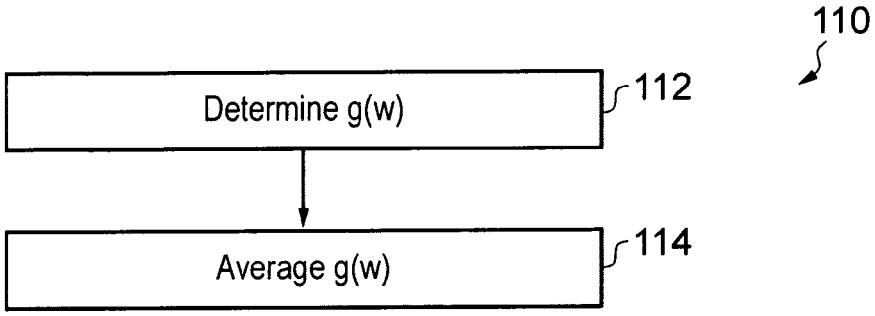
FIG. 5 schematically illustrates a method for determining an inter-channel parameter from the selected inter-channel prediction model H.

FIG. 5 schematically illustrates a method 110 for determining a second interim inter-channel parameter from the selected inter-channel prediction model $H_i$ in a subject sub band.

At block 112, a magnitude of the inter-channel prediction model is determined.

The inter-channel level difference parameter is determined from the magnitude response of the model.

The inter channel level difference of the model for the subject sub band is determined as $$g(\omega)=|H(e^{j\omega})| \qquad \text{Equation 11}$$

Again, the inter channel level difference can be estimated by calculating the average of $g(\omega)$ over a number of sub bands covering the whole or a subset of the frequency range.

At block 114, an average of $g(\omega)$ over a number of sub bands covering the whole or a subset of the frequency range may be determined. The average may be used as inter channel level difference parameter for the respective frame.

Figure 7:
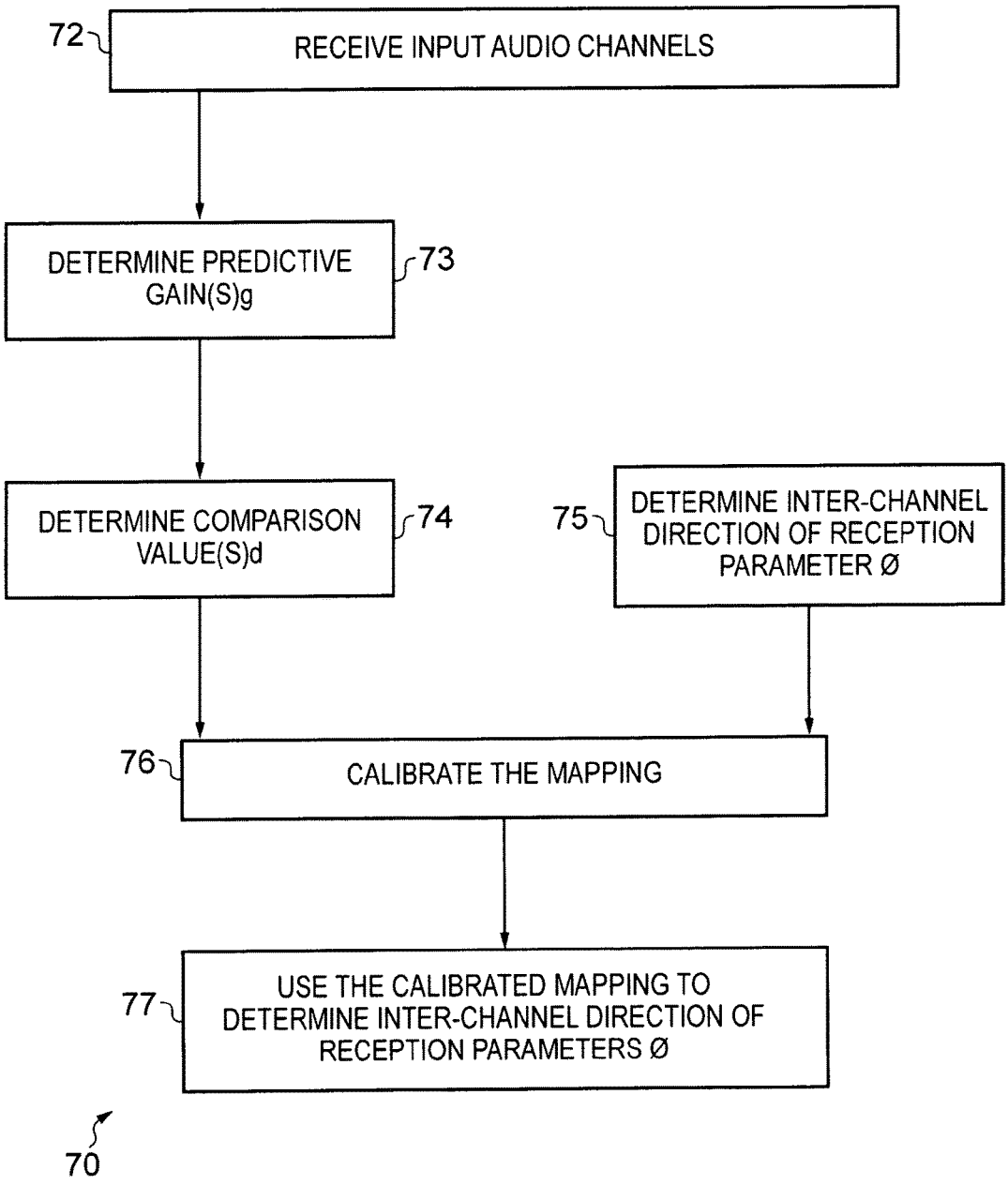
FIG. 7 schematically illustrates a method for determining an inter-channel direction of reception parameter.

FIG. 7 schematically illustrates a method 70 for determining one or more inter-channel direction of reception parameters.

At block 72, the input audio channels are received. In the following example, two input channels are used but in other implementations a larger number of input channels may be used. For example, a larger number of channels may be reduced to a series of pairs of channels that share the same reference channel. As another example, a larger number of input channels can be grouped into channel pairs based on the channel configuration. The channels corresponding to adjacent microphones could be linked together for inter channel prediction models and corresponding prediction gain pairs. For example, when having N microphones in an array configuration, the direction of arrival estimation could form N−1 channel pairs out of the adjacent microphone channels. The direction of arrival (or IDR) parameter could then be determined for each channel pair resulting in N−1 parameters.

At block 73, the prediction gains for the input channels are determined The prediction gain $g_i$ may be defined as:

$$g_1 = \frac{x_2(n)^T x_2(n)}{e_1(n)^T e_1(n)} \quad \text{−Equation 12}$$

$$g_2 = \frac{x_1(n)^T x_1(n)}{e_2(n)^T e_2(n)}. \quad \text{−Equation 13}$$

with respect to FIG. 3.

The first prediction gain is an example of a first metric $g_1$ of an inter-channel prediction model that predicts the first input audio channel. The second prediction gain is an example of a second metric $g_2$ of an inter-channel prediction model that predicts the second input audio channel.

At block 74, the prediction gains are used to determine one or more comparison values.

An example of a suitable comparison value is the prediction gain difference d, where $$d=\log_{10}(g_1)-\log_{10}(g_2) \quad \text{Equation 14}$$

Thus the block 73 determines a comparison value (e.g. d) that compares the first metric (e.g. $g_1$) and the second metric (e.g. $g_2$). The first metric (e.g. $g_1$) is used as an argument of a slowly varying function (e.g. logarithm) to obtain a modified first metric (e.g. $\log_{10}(g_1)$). The second metric (e.g. $g_2$) is used as an argument of the same slowly varying function (e.g. logarithm) to obtain a modified second metric (e.g. $\log_{10}(g_2)$). The comparison value d is determined as a comparison e.g. a difference between the modified first metric and the modified second metric.

The comparison value (e.g. prediction gain difference) d may be proportional to the inter-channel direction of reception parameter. Thus the greater the difference in prediction gain, the larger the direction of reception angle of the sound source compared to a centre of axis perpendicular to a listening line, e.g. to a line connecting the microphones used for capturing the respective audio channels such as the linear direction in a linear a microphone array.

The comparison value (e.g. d) can be mapped to the inter-channel direction of reception parameter $\phi$ which is an angle describing the direction of reception using a mapping function $\alpha(\ )$. As an example, the prediction gain difference d may be mapped linearly to the direction of reception angle in the range of $[-\pi/2 \ldots \pi/2]$ for example by using a mapping function $\alpha$ as follows $$d=\alpha\phi \quad \text{Equation 15}$$

The mapping can also be a constant or a function of time and sub band, i.e. $\alpha(t,m)$.

At block 76 the mapping is calibrated. This block uses the determined comparisons (block 74) and a reference inter-channel direction of reception parameter (block 75).

The calibrated mapping function maps the inter-channel direction of reception parameter to the comparison value. The mapping function may be calibrated from the comparison value (from block 74) and an associated inter-channel direction of reception parameter (from block 75).

The associated inter-channel direction of reception parameter may be determined at block 75 using an absolute inter-channel time difference parameter $\tau$ or determined using an absolute inter-channel level difference parameter $\Delta L_n$ in each sub band n.

The inter-channel time difference (ITD) parameter $\tau_n$ and the absolute inter-channel level difference (ILD) parameter $\Delta L_n$ may be determined by the audio scene analyser 54.

The parameters may be estimated within a transform domain time-frequency slot, i.e. in a frequency sub band for an input frame. Typically, ILD and ITD parameters are determined for each time-frequency slot of the input signal, or a subset of frequency slots representing perceptually most important frequency components.

The ILD and ITD parameters may be determined between an input audio channel and a reference channel, typically between each input audio channel and a reference input audio channel.

In the following, some details of an approach are illustrated using an example with two input channels L, R and a single downmix signal. However, the representation can be generalized to cover more than two input audio channels and/or a configuration using more than one downmix signal.

The inter-channel level difference (ILD) for each sub band $\Delta L_n$ is typically estimated as:

$$\Delta L_n = 10\log_{10}\left(\frac{s_n^{LT} s_n^L}{s_n^{RT} s_n^R}\right) \quad \text{−Equation 16}$$

where $s_n^L$ and $s_n^R$ are time domain left and right channel signals in sub band n, respectively.

The inter-channel time difference (ITD), i.e. the delay between the two input audio channels, may be determined in as follows $$\tau_n=\arg\max_d\{\Phi_n(k,d)\} \quad \text{Equation 17}$$

where $\Phi_n(d,k)$ is normalised correlation $$\Phi_n(d,k) = \frac{s_n^L(k-d_1)^T s_n^R(k-d_2)}{\sqrt{(s_n^L(k-d_1)^T s_n^L(k-d_1))(s_n^R(k-d_2)^T s_n^R(k-d_2))}} \quad \text{−Equation 18}$$

where $$d_1=\max\{0,-d\}$$

$$d_2=\max\{0,d\}$$

Alternatively, the parameters may be determined in Discrete Fourier Transform (DFT) domain. Using for example windowed Short Time Fourier Transform (STFT), the sub band signals above are converted to groups of transform coefficients. $S_n^L$ and $S_n^R$ are the spectral coefficient two input audio channels L, R for sub band n of the given analysis frame, respectively. The transform domain ILD may be determined as:

$$\Delta L_n = 10\log_{10}\left(\frac{S_n^{L*} S_n^L}{S_n^{R*} S_n^R}\right) \quad \text{−Equation 19}$$

where * denotes complex conjugate.

In embodiments of the invention, any transform that results in complex-valued transformed signal may be used instead of DFT.

However, the time difference (ITD) may be more convenient to handle as an inter-channel phase difference (ICPD)

$$\phi_n = \angle(S_n^L * S_n^R), \quad \text{Equation 21}$$

The time and level difference parameters could be determined only for limited number of sub bands and they do not need to be updated in every frame.

Then at block 75, the inter-channel direction of reception parameter is determined. As an example, the reference inter-channel direction of reception parameter $\phi$ may be determined using an absolute inter-channel time difference (ITD) parameter $\tau$ from:

$$\tau = (|x|\sin(\phi))/c, \quad \text{Equation 22}$$

where |x| is the distance between the microphones and c is the speed of sound.

As another example, the reference inter-channel direction of reception parameter $\phi$ may be determined using inter-channel signal level differences in the (amplitude) panning law as follows $$\sin\phi = \frac{l_1 - l_2}{l_1 + l_2} \quad \text{–Equation 23}$$

where $l_i = \sqrt{x_i(n)^T x_i(n)}$ is the signal level parameter of channel i. The ILD cue determined in Equation 16 can be utilised to determine the signal levels for the panning law. First the signals $s_n^L$ and $s_n^R$ are retrieved from the mono downmix by $$s_n^L = 2\frac{10^{\frac{\Delta L_n}{20}}}{10^{\frac{\Delta L_n}{20}} + 1} s_n$$

$$s_n^R = 2\frac{1}{10^{\frac{\Delta L_n}{20}} + 1} s_n$$

Where $s_n$ is the mono downmix. Next the signal levels needed in Equation 23 is determined as $l_1 = \sqrt{s_n^{L^T} s_n^L}$ and $l_2 = \sqrt{s_n^{R^T} s_n^R}$.

Referring back to block 76, the mapping function may be calibrated from the obtained comparison value (from block 74) and the associated reference inter-channel direction of reception parameter (from block 75).

The mapping function may be a function of time and sub band and is determined using the available obtained comparison values and the reference inter-channel direction of reception parameters associated with those comparison values. If the comparison values and associated reference inter-channel direction of reception parameters are available in more than one sub band, the mapping function could be fitted within the available data as a polynomial.

The mapping function may be intermittently recalibrated. The mapping function $\alpha(t,n)$ may be recalibrated at regular intervals or based on the input signal characteristics, when the mapping accuracy is getting above a predetermined threshold, or even in every frame and every sub band.

The recalibration may occur for only a subset of sub bands

Next block 77 uses the calibrated mapping function to determine inter-channel direction of reception parameters.

An inverse of the mapping function is used to map comparison values (e.g. d) to inter-channel direction of reception parameters (e.g. $\hat{\phi}_n$).

For example, the direction of reception may be determined in the encoder 54 in each sub band n using the equation $$\hat{\phi}_n = \alpha^{-1}(t,n) d_n.$$

The direction of reception parameter estimate $\hat{\phi}_n$ is the output 55 of the binaural encoder 54 according to an embodiment of this invention.

An inter-channel coherence cue may also be provided as an audio scene parameter 55 for complementing the spatial image parameterisation. However, for high frequency sub bands above 1500 Hz, when the inter channel time or phase differences typically become ambiguous, the absolute prediction gains could be used as the inter-channel coherence cue.

In some embodiments, a direction of reception parameter $\hat{\phi}_n$ may be provided to a destination only if $\hat{\phi}_n(t)$ is different by at least a threshold value from a previously provided direction of reception parameter $\hat{\phi}_n(t-n)$.

In some embodiments of the invention the mapping function $\alpha(t,n)$ may be provided for the rendering side as a parameter 55. However, the mapping function is not necessarily needed in rendering the spatial sound in the decoder.

The inter channel prediction gain typically evolves smoothly. It may be beneficial to smooth (and average) the mapping function $\alpha^{-1}(t,n)$ over a relatively long time period of several frames. Even when the mapping function is smoothed, the direction of reception parameter estimate $\hat{\phi}_n$ maintains fast reaction capability to sudden changes since the actual parameter is based on the frame and sub band based prediction gain.

Figure 6:
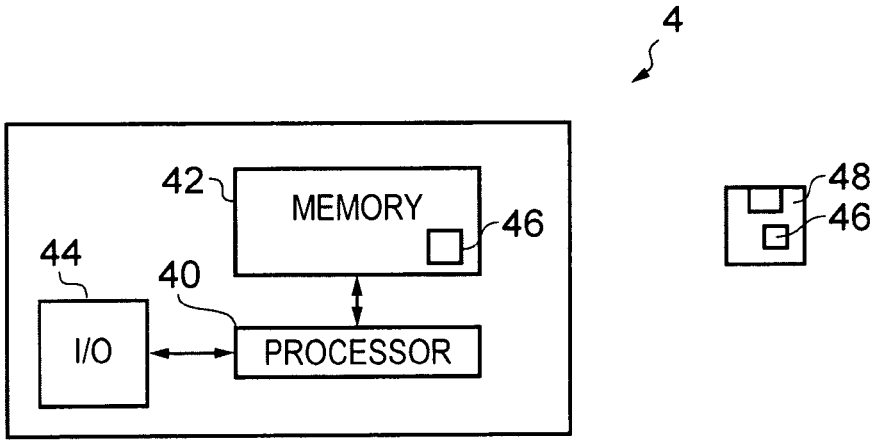
FIG. 6 schematically illustrates components of a coder apparatus that may be used as an encoder apparatus and/or a decoder apparatus.

FIG. 6 schematically illustrates components of a coder apparatus that may be used as an encoder apparatus 4 and/or a decoder apparatus 80. The coder apparatus may be an end-product or a module. As used here 'module' refers to a unit or apparatus that excludes certain parts/components that would be added by an end manufacturer or a user to form an end-product apparatus.

Implementation of a coder can be in hardware alone (a circuit, a processor . . . ), have certain aspects in software including firmware alone or can be a combination of hardware and software (including firmware).

The coder may be implemented using instructions that enable hardware functionality, for example, by using executable computer program instructions in a general-purpose or special-purpose processor that may be stored on a computer readable storage medium (disk, memory etc) to be executed by such a processor.

In the illustrated example an encoder apparatus 4 comprises: a processor 40, a memory 42 and an input/output interface 44 such as, for example, a network adapter.

The processor 40 is configured to read from and write to the memory 42. The processor 40 may also comprise an output interface via which data and/or commands are output by the processor 40 and an input interface via which data and/or commands are input to the processor 40.

The memory 42 stores a computer program 46 comprising computer program instructions that control the operation of the coder apparatus when loaded into the processor 40. The computer program instructions 46 provide the logic and routines that enables the apparatus to perform the methods illustrated in FIGS. 3 to 9. The processor 40 by reading the memory 42 is able to load and execute the computer program 46.

The computer program may arrive at the coder apparatus via any suitable delivery mechanism 48. The delivery mechanism 48 may be, for example, a computer-readable storage medium, a computer program product, a memory device, a record medium such as a CD-ROM or DVD, an article of manufacture that tangibly embodies the computer program 46. The delivery mechanism may be a signal configured to reliably transfer the computer program 46. The coder apparatus may propagate or transmit the computer program 46 as a computer data signal.

Although the memory 42 is illustrated as a single component it may be implemented as one or more separate components some or all of which may be integrated/removable and/or may provide permanent/semi-permanent/dynamic/cached storage References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

Decoding

Figure 9:
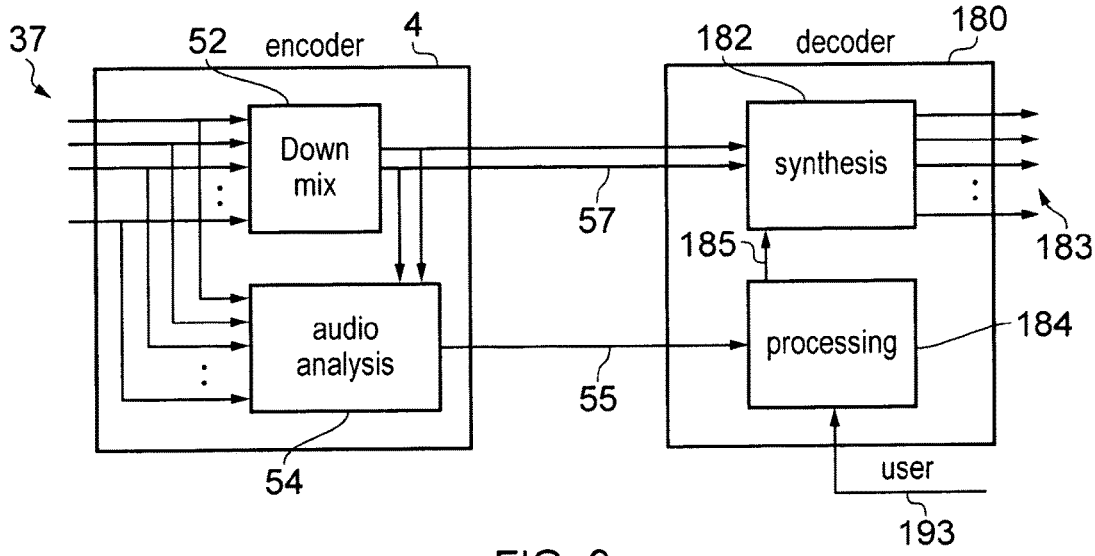
FIG. 9 schematically illustrates a decoder apparatus which receives input signals from the encoder apparatus.

FIG. 9 schematically illustrates a decoder apparatus 180 which receives input signals 57, 55 from the encoder apparatus 4.

The decoder apparatus 180 comprises a synthesis block 182 and a parameter processing block 184. The signal synthesis, for example BCC synthesis, may occur at the synthesis block 182 based on parameters provided by the parameter processing block 184.

A frame of downmixed signal(s) 57 consisting of N samples $s_0, \ldots, s_{N-1}$ is converted to N spectral samples $S_0, \ldots, S_{N-1}$ e.g. with DTF transform.

Inter-channel parameters (BCC cues) 55, for example IDR described above, are output from the parameter processing block 184 and applied in the synthesis block 182 to create spatial audio signals, in this example binaural audio, in a plurality (M) of output audio channels 183.

The time difference between two channels may be defined by:

$$\tau=(|x|\sin(\phi))/c,$$

where |x| is the distance between the loudspeakers and c is the speed of sound.

The level difference between two channels may be defined by:

$$\sin\phi = \frac{l_1 - l_2}{l_1 + l_2}$$

Thus the received inter-channel direction of reception parameter $\hat{\phi}_n$ may be converted the amplitude and time/phase difference panning law to create inter channel level and time difference cues for upmixing the mono downmix. This may be especially beneficial for headphone listening when the phase differences of the output channel could be utilised in full extent from the quality of experience point of view.

Alternatively, the received inter-channel direction of reception parameter $\hat{\phi}_n$ may be converted to only the inter-channel level difference cue for upmixing the mono downmix without time delay rendering. This may, for example, be used for loudspeaker representation.

The direction of reception estimation based rendering is very flexible. The output channel configuration does not need to be identical to that of the capture side. Even if the parameterisation is performed using a two-channel signal, e.g using only two microphones, the audio could be rendered using an arbitrary number of channels.

It should be noted that the synthesis using frequency dependent direction of receipt (IDR) parameters recreates the sound components representing the audio sources. The ambience may still be missing and it may be synthesised using the coherence parameter.

A method for synthesis of the ambient component based on the coherence cue consists of decorrelation of a signal to create late reverberation signal. The implementation may consist of filtering output audio channels using random phase filters and adding the result into the output. When a different filter delays are applied to output audio channels, a set of decorrelated signals is created.

Figure 8:
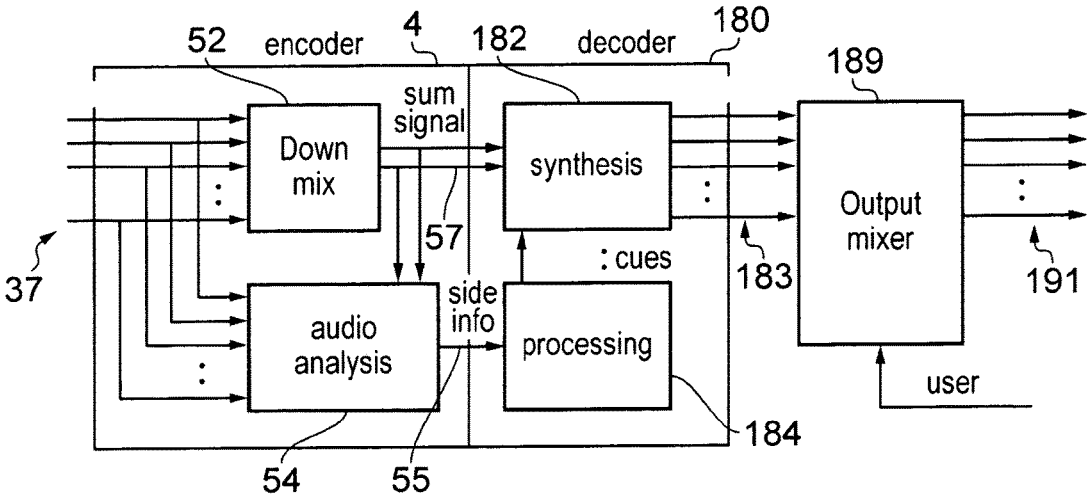
FIG. 8 schematically illustrates a decoder in which the multi-channel output of the synthesis block is mixed into a plurality of output audio channels.

FIG. 8 schematically illustrates a decoder in which the multi-channel output of the synthesis block 182 is mixed, by mixer 189 into a plurality (K) of output audio channels 191, knowing that the number of output channels may be different to number of input channels ($K \neq M$).

This allows rendering of different spatial mixing formats. For example, the mixer 189 may be responsive to user input 193 identifying the user's loudspeaker setup to change the mixing and the nature and number of the output audio channels 191. In practice this means that for example a multi-channel movie soundtrack mixed or recorded originally for a 5.1 loudspeaker system, can be upmixed for a more modern 7.2 loudspeaker system. As well, music or conversation recorded with binaural microphones could be played back through a multi-channel loudspeaker setup.

It is also possible to obtain inter-channel parameters by other computationally more expensive methods such as cross correlation. In some embodiments, the above described methodology may be used for a first frequency range and cross-correlation may be used for a second, different, frequency range.

The blocks illustrated in the FIGS. 2 to 5 and 7 to 9 may represent steps in a method and/or sections of code in the computer program 46. The illustration of a particular order to the blocks does not necessarily imply that there is a required or preferred order for the blocks and the order and arrangement of the block may be varied. Furthermore, it may be possible for some steps to be omitted.

Although embodiments of the present invention have been described in the preceding paragraphs with reference to various examples, it should be appreciated that modifications to the examples given can be made without departing from the scope of the invention as claimed. For example, the technology described above may also be applied to the MPEG surround codec Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. A method comprising:

receiving a first input audio channel and a second input audio channel that jointly represent a spatial audio image;

determining a first metric as a prediction gain of an inter-channel prediction model that predicts the first input audio channel based at least in part on the second audio input channel, wherein the prediction model is one of an autoregressive model, a moving average model, and an autoregressive moving average model and a second metric as a prediction gain of an inter-channel prediction model that predicts the second input audio channel based at least in part on the first audio input channel, wherein the prediction model is one of an autoregressive model, a moving average model, and an autoregressive moving average model, wherein determining the first metric comprises computing the respective prediction gain as the ratio between energy of the predicted first input audio channel and the energy of a prediction error signal determined as the difference between the first input audio channel and the predicted first input audio channel, and wherein determining the second metric comprises computing the respective prediction gain as the ratio between energy of the predicted second input audio channel and the energy of a prediction error signal determined as the difference between the second input audio channel and the predicted second input audio channel;

computing a comparison value that compares the first metric and the second metric; and computing at least one inter-channel direction of reception parameter based on the comparison value.

2. A method as claimed in claim 1, further comprising providing an output signal comprising a downmixed signal and the at least one inter-channel direction of reception parameter.

3. A method as claimed in claim 1, further comprising:

using the first metric as an operand of a slowly varying function to obtain a modified first metric;

using the second metric as an operand of the same slowly varying function to obtain a modified second metric;

determining as the comparison value, a difference between the modified first metric and the modified second metric.

4. A method as claimed in claim 3, wherein the comparison value is a difference between a logarithm of the first metric and the logarithm of the second metric.

5. A method as claimed in claim 1, further comprising:

mapping the inter-channel direction of reception parameter to the comparison value using a mapping function calibrated from the obtained comparison value and an associated inter-channel direction of reception parameter.

6. A method as claimed in claim 5, wherein the associated inter-channel direction of reception parameter is determined using at least one of an absolute inter-channel time difference parameter and an absolute inter-channel level difference parameter.

7. A method as claimed in claim 5, further comprising recalibrating the mapping function intermittently.

8. A method as claimed in claim 5, wherein the mapping function is a function of time and sub band and is determined using available obtained comparison values and associated inter-channel direction of reception parameters.

9. A method as claimed in claim 1, wherein the inter-channel prediction model represents a predicted sample of an audio channel in terms of a different audio channel.

10. A method as claimed in claim 9, further comprising minimizing a cost function for the predicted sample to determine a inter-channel prediction model and using the determined inter-channel prediction model to determine at least one inter-channel parameter.

11. A method as claimed in claim 1, further comprising segmenting at least the first input audio channel and second input audio channel in the time slots in the time domain and sub bands in the frequency domain and using an inter-channel prediction model to form an inter-channel direction of reception parameter for each of a plurality of sub bands.

12. A method as claimed in claim 1 further comprising using at least one selection criterion for selecting an inter-channel prediction model for use, wherein the at least one selection criterion is based upon a performance measure of the inter-channel prediction model.

13. A method as claimed in claim 12, wherein the performance measure is prediction gain.

14. A method as claimed in claim 1 comprising selecting an inter-channel prediction model for use from a plurality of inter-channel prediction models.

15. A non-transitory computer readable medium storing a program of instructions, execution of which by at least on processor configures an apparatus to perform the method of claim 1.

16. A non-transitory computer readable medium storing a program of instructions, execution of which by at least on processor configures an apparatus to at least:

receive a first input audio channel and a second input audio channel that jointly represent a spatial audio image;

determine a first metric as a prediction gain of an inter-channel prediction model that predicts the first input audio channel based at least in part on the second audio input channel, wherein the prediction model is one of an autoregressive model, a moving average model, and an autoregressive moving average model, and a second metric as a prediction gain of an inter-channel prediction model that predicts the second input audio channel based at least in part on the first audio input channel, wherein the prediction model is one of an autoregressive model, a moving average model, and an autoregressive moving average model, wherein determining the first metric comprises computing the respective prediction gain as the ratio between energy of the predicted first input audio channel and the energy of a prediction error signal determined as the difference between the first input audio channel and the predicted first input audio channel, and wherein determining the second metric comprises computing the respective prediction gain as the ratio between energy of the predicted second input audio channel and the energy of a prediction error signal determined as the difference between the second input audio channel and the predicted second input audio channel;

compute a comparison value that compares the first metric and the second metric; and compute at least one inter-channel direction of reception parameter based on the comparison value.

17. A non-transitory computer readable medium as claimed in claim 16, wherein the apparatus is further configured to:

use the first metric as an operand of a slowly varying function to obtain a modified first metric;

use the second metric as an operand of the same slowly varying function to obtain a modified second metric; and determine as the comparison value, a difference between the modified first metric and the modified second metric.

18. A non-transitory computer readable medium as claimed in claim 16, wherein the comparison value is a difference between a logarithm of the first metric and the logarithm of the second metric.

19. An apparatus comprising:

at least one processor;

memory storing a program of instructions;

wherein the memory storing the program of instructions is configured to, with the at least one processor, cause the apparatus to at least:

receive a first input audio channel and a second input audio channel that jointly represent a spatial audio image;

determine a first metric as a prediction gain of an inter-channel prediction model that predicts the first input audio channel based at least in part on the second audio input channel, wherein the prediction model is one of an autoregressive model, a moving average model, and an autoregressive moving average model, and a second metric as a prediction gain of an inter-channel prediction model that predicts the second input audio channel based at least in part on the first audio input channel, wherein the prediction model is one of an autoregressive model, a moving average model, and an autoregressive moving average model, wherein determining the first metric comprises computing the respective prediction gain as the ratio between energy of the predicted first input audio channel and the energy of a prediction error signal determined as the difference between the first input audio channel and the predicted first input audio channel, and wherein determining the second metric comprises computing the respective prediction gain as the ratio between energy of the predicted second input audio channel and the energy of a prediction error signal determined as the difference between the second input audio channel and the predicted second input audio channel;

compute a comparison value that compares the first metric and the second metric; and compute at least one inter-channel direction of reception parameter.

20. An apparatus as claimed in claim 19, wherein the apparatus is further caused to:

use the first metric as an operand of a slowly varying function to obtain a modified first metric;

use the second metric as an operand of the same slowly varying function to obtain a modified second metric; and use as the comparison value, a difference between the modified first metric and the modified second metric.

21. A method comprising:

receiving at least one inter-channel direction of reception parameter, wherein the at least one inter-channel direction of reception parameter is computed based on a comparison value, wherein the comparison value is computed as a comparison of a first metric and a second metric that jointly represent a spatial audio image, wherein the first metric is determined as prediction gain of an inter-channel prediction model that predicts a first audio input channel based at least on a second audio input channel, wherein the prediction model is one of an autoregressive model, a moving average model, and an autoregressive moving average model, and the second metric is determined as a prediction gain of an inter-channel prediction model that predicts a second input audio channel based at least on a first audio input channel, wherein the prediction model is one of an autoregressive model, a moving average model, and an autoregressive moving average model, wherein determining the first metric comprises computing the respective prediction gain as the ratio between energy of the predicted first input audio channel and the energy of a prediction error signal determined as the difference between the first input audio channel and the predicted first input audio channel, and wherein determining the second metric comprises computing the respective prediction gain as the ratio between energy of the predicted second input audio channel and the energy of a prediction error signal determined as the difference between the second input audio channel and the predicted second input audio channel; and using a downmixed signal and the at least one inter-channel direction of reception parameter to render multi-channel audio output.

22. A method as claimed in claim 21 further comprising:

converting the at least one inter-channel direction of reception parameter to an inter-channel time difference before rendering the multi-channel audio output.

23. A method as claimed in claim 21 further comprising:

converting the at least one inter-channel direction of reception parameter to level values using a panning law.

* * * * *